United States Patent [19]

Wisotsky

[11] 4,153,422

[45] May 8, 1979

[54] POLYMER COMBINATIONS USEFUL IN DISTILLATE HYDROCARBON OILS TO IMPROVE COLD FLOW PROPERTIES

[75] Inventor: Max J. Wisotsky, Highland Park, N.J.

[73] Assignee: Exxon Research & Engineering Co., Florham Park, N.J.

[21] Appl. No.: 565,748

[22] Filed: Apr. 7, 1975

[51] Int. Cl.[2] ..... C10L 1/18

[52] U.S. Cl. ..... 44/62; 44/70

[58] Field of Search ..... 44/62, 70, 66, 71

[56] References Cited

U.S. PATENT DOCUMENTS

| | | | |
|---|---|---|---|
| 3,275,427 | 9/1966 | Brownawell et al. | 44/62 |
| 3,620,696 | 11/1971 | Hollyday, Jr. et al. | 44/62 |
| 3,661,541 | 5/1972 | Hollyday, Jr. | 44/62 |
| 3,726,653 | 4/1973 | van der Meij et al. | 44/62 |
| 3,792,983 | 2/1974 | Tunkel et al. | 44/62 |
| 3,832,150 | 8/1974 | Feldman | 44/62 |
| 4,010,006 | 3/1977 | Price | 44/62 |

FOREIGN PATENT DOCUMENTS

| | | | |
|---|---|---|---|
| 1323547 | 3/1963 | France | 44/62 |

*Primary Examiner*—Winston A. Douglas
*Assistant Examiner*—Y. Harris-Smith
*Attorney, Agent, or Firm*—Roland A. Dexter; Frank T. Johmann

[57] ABSTRACT

Oil soluble ethylene-vinyl ester copolymers having a $\bar{M}_n$ less than about 4000 in combination with an oil soluble polyester material, such as a homopolymer or copolymer, comprising at least 10% by weight $C_{14}$ to $C_{16}$ substantially straight-chain alkyl esters of acrylic or methacrylic acid, are useful in improving the cold flow properties of distillate hydrocarbon oils.

3 Claims, No Drawings

POLYMER COMBINATIONS USEFUL IN DISTILLATE HYDROCARBON OILS TO IMPROVE COLD FLOW PROPERTIES

BACKGROUND OF THE INVENTION

1. Field of the Invention

The invention relates to an additive combination of (a) an ethylene vinyl ester copolymer with (b) an oil-soluble polyester material, e.g., a homopolymer or copolymer of acrylic or methacrylic acid, wherein at least 10 wt. % of said polymer is derived from an ester having substantially straight chain $C_{14}$ to $C_{16}$ alkyl groups extending from ester linkages. This combination is particularly useful in middle distillate fuel oils containing a fraction boiling above 370° C., for controlling the size of wax crystals that form at low temperatures.

2. Description of the Prior Art

Various polymers, useful as middle distillate pour point depressants, prepared from ethylene have been described in the patent literature. These pour depressants include copolymers of ethylene and vinyl esters of lower fatty acids such as vinyl acetate (U.S. Pat. No. 3,048,479); copolymers of ethylene and alkyl acrylate (Canadian Patent No. 676,875); terpolymers of ethylene with vinyl esters and alkyl fumarates (U.S. Pat. Nos. 3,304,261 and 3,341,309); polymers of ethylene (British Patents Nos. 848,777 and 993,744); chlorinated polyethylene (Belgian Patent No. 707,371 and U.S. Pat. No. 3,337,313); etc.

Polymers having alkyl groups in the range of $C_6$ to $C_{18}$, such as homopolymers and copolymers of olefins, alkyl esters of unsaturated dicarboxylic acids (e.g., copolymers of dialkyl fumarate with vinyl acetate), and copolymers of olefins and said esters, are known in the art, principally as lube oil pour depressants and/or V.I. improvers. For example, U.S. Pat. No. 2,379,728 teaches olefin polymers as lube pour depressants; U.S. Pat. No. 2,460,035 shows polyfumarates; U.S. Pat. No. 2,936,300 shows a copolymer of dialkyl fumarate and vinyl acetate; while U.S. Pat. No. 2,542,542 teaches copolymers of olefins, such as octadecene with maleic anhydride esterified with alcohol, e.g., lauryl alcohol, in lube and heating oils.

Synergistic pour point depressing combinations of various members of the above-noted two types of polymers in heavy fuels, e.g., residua and flash distillate fuels, which fuels contain relatively large amounts of waxes having 20 or more carbon atoms, is taught in U.S. Pat. No. 3,726,653. The cold flow of middle distillate fuels is improved by the additive combination of low $\overline{M}_n$ ethylene copolymers such as ethylene-vinyl acetate and the polymer of a lauryl acrylic acid ester according to U.S. Pat. No. 3,275,427.

SUMMARY OF THE INVENTION

The present invention is based on the finding that ethylene vinyl ester copolymers having an $\overline{M}_n$ of less than about 4000 in combination with a second polymer which is a polyester, i.e. homopolymer or copolymer comprising at least 10% by weight, preferably at least 25 wt. % of $C_{14}$ to $C_{16}$ substantially straight chain alkyl ester of an ethylenically unsaturated monocarboxylic acid, e.g. acrylic or methacrylic acid, can give synergistic results in controlling wax crystal size in distillate hydrocarbon oils.

When the polyester is a copolymer, it is limited to containing less than about 25 wt. % total of one or more additional monomer moieties, (i.e. in addition to said $C_{14}$ to $C_{16}$ alkyl ester) such as alkyl ester of ethylenically unsaturated mono- or dicarboxylic acids having $C_6$ to $C_{44}$ alkyl groups extending from ester linkages.

In general, the additive combination of the invention will comprise one part by weight of the ethylene copolymer per about 0.1 to 20, preferably 0.2 to 4 parts by weight of said polyester, i.e. polyacrylate. The distillate hydrocarbon oil compositions of the invention will contain a total of about 0.001 to 1.0, preferably 0.005 to 0.1 wt. % of said additive combination. Concentrates of 1 to 60 wt. % of said additive combination in 40 to 99 wt. % of mineral oil, e.g., kerosene, can be prepared for ease of handling.

The Ethylene Copolymer

The ethylene copolymer will have a polymethylene backbone which is divided into segments by hydrocarbon, halogen, or oxy-hydrocarbon side chains (usually prepared by free radical polymerization which will result in some branching) and comprise about 3 to 40, preferably 4 to 20, molar proportions of ethylene per molar proportion of a second ethylenically unsaturated monomer, which latter monomer can be a single monomer or a mixture of such monomers in any proportion. These polymers will generally have a number average molecular weight, designated throughout as $\overline{M}_n$, in the range of less than about 4000, preferably about 1500 to about 3500 ($\overline{M}_n$) (values herein are measured up to about 25,000 by Vapor Pressure Osmometry (VPO) and by Gel Permeation Chromatography (GPC) above about 25,000).

The unsaturated ester monomers, copolymerizable with ethylene are the ethylenically unsaturated alcohol monoesters of $C_2$ to $C_{17}$ monocarboxylic acids, preferably $C_2$ to $C_5$ monocarboxylic acid, of the general formula:

$$R_1COOR_2$$

wherein $R_1$ is a $C_1$ to $C_{16}$, preferably a $C_1$ to $C_8$, e.g., $C_1$ to $C_4$, straight or branched chain alkyl group; and $R_2$ is the radical of a monoethylenically unsaturated alcohol containing 2 to 3 carbons. The ester monomer includes the preferably vinyl alcohol esters of $C_2$ to $C_{17}$ monocarboxylic acid, preferably $C_2$ to $C_9$, e.g., $C_2$ to $C_5$ monocarboxylic acid. Examples of such esters include vinyl acetate, vinyl isobutyrate, vinyl laurate, vinyl myristate, vinyl palmitate, etc.

In accordance with this invention at least about 5 wt. %, preferably at least about 10 wt. % of the ethylene-ester polymer will be derived from the alkyl monocarboxylic acid-ethylenically unsaturated alcohol ester monomer moiety. In accordance with the above instructions, other monomers can be copolymerized with the ethylene-ester monomers to produce useful ethylene copolymers.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride (although essentially the same result can be obtained by chlorinating polyethylene, e.g., to a chlorine content of about 10 to 35 wt. %), acrylonitrile, acrylamide, etc.

These oil soluble ethylene-ester copolymers are generally formed using a free radical promoter, or in some cases they can be formed by thermal polymerization, or they can be formed by Ziegler catalysis in the case of ethylene with other olefins. The polymers produced by free radical appear to be the more important and can be formed as follows: Solvent, and 5–50 wt. %, of the total amount of monomer other than ethylene; i.e., the ester monomer, used in the batch, are charged to a stainless steel pressure vessel which is equipped with a stirrer. The temperature of the pressure vessel is then brought to the desired reaction temperature, e.g., 70° to 250° C., and pressured to the desired pressure with ethylene, e.g., 700 to 25,000 psig., usually 900 to 7,000 psig. Preferred are temperatures in the range of 70° to 160° C. Promoter, usually dissolved in solvent so that it can be pumped, and additional amounts of the second monomer, i.e. the unsaturated ester, can be added to the vessel continuously, or at least periodically, during the reaction time, which continuous or periodic addition gives a more homogeneous copolymer product as compared to adding all the unsaturated ester at the beginning of the reaction. Also during this reaction time, as ethylene is consumed in the polymerization reaction, additional ethylene can be supplied through a pressure controlling regulator so as to maintain the desired reaction pressure fairly constant at all times. Following the completion of the reaction, usually a total reaction time of ¼ to 10 hours will suffice, the liquid phase of the pressure vessel contents is distilled to remove the solvent and other volatile constituents of the reacted mixture, leaving the polymer as residue. Usually to facilitate handling and later oil blending, the polymer is dissolved in a light mineral oil to form a concentrate usually containing 10 to 60 wt. % of polymer.

Usually, based upon 100 parts by weight of polymer to be produced, then about 50 to 1200, preferably 100 to 600 parts by weight of solvent, usually a hydrocarbon solvent such as benzene, hexane, cyclohexane, etc., and about 1 to 20 parts by weight of promoter will be used.

The promoter can be any of the conventional free radical promoters, such as peroxide or azo-type promoters, including the acyl peroxides of $C_2$ to $C_{18}$ branched or unbranched carboxylic acids, as well as other common promoters. Specific examples of such promoters include dibenzoyl peroxide, di-tertiary butyl peroxide, t-butyl perbenzoate, t-butyl peroctoate, t-butyl hydroperoxide, alpha, alpha', azo-diisobutyronitrile, dilauroyl peroxide, etc. Dilauroyl peroxide is preferred when the polymer is made at a low temperature, e.g. 70° to 135° C., while di-tert. butyl peroxide is preferred at higher polymerization temperatures.

Polyester Copolymer

These oil soluble polyester polymers which in preferred form are polymers of acrylates (including homologues of acrylates), will generally have a $M_n$ in the range of about 1,000 to 200,000, preferably 2,000 to 100,000 as measured, for example, by Vapor Pressure Osmometry such as by a Mechrolab Vapor Pressure Osmometer. In accordance with this invention, at least about 10 wt. %, preferably at least about 25 wt. % of the polyester will be derived from a substantially straight chain alkyl monocarboxylic acid ester monomer moiety, said alkyl groups extending from the ester linkages having from 14 to 16 carbons. These polyesters thus have a cold flow improving content of $C_{14}$ to $C_{16}$ alkyl groups, i.e. most preferably at least 35 wt. % of said groups, forming the monoester of an ethylenically unsaturated $C_4$ to $C_8$ monocarboxylic acid, whereby cold flow synergism in distillate hydrocarbon oils is realized when said polyesters are used in combination with said ethylene polymers.

These esters of $C_4$ to $C_8$ monocarboxylic acids useful for preparing the polymer are preferably represented by the general formula (acrylic esters including homologues thereof):

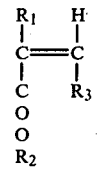

wherein $R_1$ is hydrogen or a $C_1$ to $C_4$ alkyl group, e.g., methyl, $R_2$ is a $C_{14}$ to $C_{16}$ alkyl group and $R_3$ is hydrogen or a $C_1$ to $C_4$ alkyl group.

Compounds of the above type whose oil-soluble polymers are useful for the present purpose are the esters of acrylic acid, its alpha-alkyl or alpha-aryl or alpha-chloro or alpha-aza- or alpha-oxohomologues and monohydric alcohols containing more than three carbon atoms such as the hexyl, octyl, decyl, lauryl, myristyl, cetyl, etc., esters of acrylic acid, alpha-methacrylic acid, atropic acid, cinnamic acid, crotonic acid, vinyl acetic, αchloroacrylic acid and other known alpha or beta-substituted homologues of acrylic acid. These esters are preferably those of the normal, primary saturated aliphatic alcohols, but the analogous esters of the corresponding secondary or of the branched-chain alcohols can also be used. The esters of the above acids of the acrylic series with monohydric aromatic, hydroaromatic, or ether alcohols may also be used, such as the benzyl, cyclohexyl, amylphenyl, n-butyloxyethyl esters. Also the vinyl esters of valeric, heptoic, lauric, palmitic, n-amyl-benzoic, naphthenic, hexahydrobenzoic, or of β-n-butyloxybutyric acid can be used.

The most effective polymers for the present purpose, from the point of view of availability and cost, are the polymerized esters of acrylic acid or alpha-methacrylic acid and monohydric, saturated, primary aliphatic alcohols containing from 14 to 16 carbon atoms in the molecule. This useful class of oil-soluble polyesters which includes the $C_{14}$ to $C_{16}$ alkyl esters of acrylic acid, homologues of acrylic acid and analogues of acrylic acid are designated for the purposes of this disclosure poly($C_{14}$ to $C_{16}$ alkyl acrylates). For the purposes of this disclosure an oil soluble polymer or copolymer has a solubility in oil of at least about 0.001% by weight at 20° C. The optimum polyesters possessing the highest solubility and stability in oils are those derived from the straight chain, monohydric primary saturated aliphatic alcohols containing 14 to 16 carbon atoms such as the tetradecyl, and hexadecyl esters. These esters need not be pure, but may be prepared from technical mixtures of the higher aliphatic alcohols such as are obtained commercially from the catalytic high pressure hydrogenation of fatty acids or their esters.

Any mixtures of two or more polymers of the esters set forth herein can also be used. These may be simple mixtures of such polymers, or they may be copolymers which can be prepared by polymerizing a mixture of two or more of the monomeric esters.

The monocarboxylic acid ester monomers described above may be copolymerized with various amounts, e.g., up to 25 wt. %, of acrylonitrile methyl, methacrylate, or other unsaturated esters or olefins.

Other Unsaturated Esters Which Can Be Copolymerized With the Monocarboxylic Acid Ester Dicarboxylic acid esters useful for preparing a copolymer can be represented by the general formula:

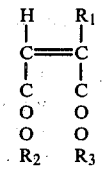

wherein $R_1$ is hydrogen or a $C_1$ to $C_4$ alkyl group, e.g., methyl, $R_2$ is a $C_4$ to $C_{16}$, e.g., $C_8$ to $C_{16}$, straight chain alkyl group, and $R_3$ is hydrogen or $R_2$. Preferred examples of such esters include fumarate and maleate esters such as dilauryl fumarate, lauryl-hexadecyl fumarate, lauryl maleate, etc.

Other esters include short chain alkyl esters having the formula:

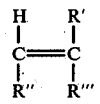

where R′ is hydrogen or a $C_1$ to $C_4$ alkyl group, R″ is —COOR″″ or —OOCR″″ where R″″ is a $C_1$ to $C_5$ alkyl group, branched or unbranched, and R‴ is R″ or hydrogen. Examples of these short chain esters are methacrylates, acrylates, fumarates, maleates, vinylates, etc. More specific examples include methyl acrylate, isopropyl acrylate, vinyl acetate, vinyl propionate, vinyl butyrate, methyl methacrylate, isopropenyl acetate, isobutyl acrylate, etc.

Another class of monomers for copolymerization in amounts up to about 25 wt. % with the poly($C_{14}$ to $C_{16}$ alkyl monocarboxylic ester) of this invention are long side chain unsaturated esters. These esters are generally unsaturated mono- and diesters represented by the formula:

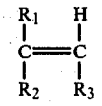

wherein $R_1$ is hydrogen or $C_1$ to $C_5$ alkyl groups; $R_2$ is —$OOCR_4$ or —$COOR_4$ group wherein $R_4$ is a $C_{20}$ to $C_{44}$, preferably $C_{20}$ to $C_{30}$, straight chain alkyl group; and $R_3$ is hydrogen or —$COOR_4$. The monomer, when $R_1$ is hydrogen and $R_2$ is —$OOCR_4$ includes vinyl alcohol esters of monocarboxylic acids. Examples of such esters include vinyl behenate, vinyl tricosanote, etc. When $R_2$ is —$COOR_4$, such esters include behenyl acrylate, behenyl methacrylate, tricosanyl acrylate, tricosanyl methacrylate, etc. Examples of monomers where $R_1$ is hydrogen, and $R_2$ and $R_3$ are both —$COOR_4$ groups, include: esters of unsaturated dicarboxylic acids such as eicosyl fumarate, docosyl fumarate, eicosyl maleate, docosyl citraconate, docosyl maleate, eicosyl citraconate, docosyl itaconate, tricosyl fumarate, tetracosyl maleate, pentacosyl citraconate, hexacosyl mesaconate, octacosyl fumarate, noncosyl maleate, triacontyl citraconate, hentriaconyl mesaconate, triaconyl fumarate, etc.

The long chain aliphatic esters described above may be prepared from aliphatic alcohols containing from 20 to 44 carbon atoms per molecule. Saturated aliphatic alcohols containing from 20 to 30 carbon atoms per molecule are preferred. Mixed esters derived by the reaction of the acids with a mixture of alcohols may be used, and one may also use a mixture of alcohols wherein a minor amount of the alcohol contains shorter chain alcohols, e.g., 1 to 19 carbon atoms per molecule. Examples of alcohols suitable for use in producing the esters include straight chain normal primary alcohols such as eicosyl, docosyl, tricosyl, tetracosyl, pentacosyl, hexacosyl, heptacosyl, octacosyl, noncosyl, and triacontyl alcohols, etc.

Commercially marketed mixtures of alcohols consisting essentially of saturated alcohols of the requisite chain length may be employed in preparing the long chain esters. One such mixture is marketed under the trade name Behenyl alcohol and is a mixture of alcohols derived from natural sources, and consists primarily of docosyl alcohol but contains minor amounts of other alcohols containing from 16 to 24 carbon atoms per molecule.

The ester polymers are generally prepared by polymerizing the ester monomers in a solution of a hydrocarbon solvent such as heptane, benzene, cyclohexane, or white oil, at a temperature generally in the range of from 60° F. to 250° F. and usually promoted with a peroxide type catalyst such as benzoyl peroxide, under a blanket of an inert gas such as nitrogen or carbon dioxide in order to exclude oxygen.

Olefins That Can Be Copolymerized With the Monocarboxylic Acid Ester

The unsaturated monocarboxylic acid ester can also be copolymerized with an alpha-olefin. However, it is usually easier to polymerize the olefin with the carboxylic acid and then esterify with 1 molar proportion of alcohol per mole of carboxylic acid. To further illustrate, the ethylenically unsaturated carboxylic acid or derivative thereof is reacted with an olefin, preferably $C_6$ to $C_{18}$ olefin, by mixing the olefin and acid, e.g., acrylic acid, usually in about equimolar amounts, and heating to a temperature of at least 80° C., preferably at least 125° C. A free radical polymerization promoter such as t-butyl hydroperoxide or di-t-butyl peroxide is normally used. The resulting copolymer thus prepared is then esterified with alcohol.

Examples of alpha-olefin monomers include propylene, butene-1, hexene-1, octene-1, decene-1, 3-methyl decene-1, tetradecene-1, styrene and styrene derivatives such as p-methyl styrene, etc.

Methacrylate Esters as the Monocarboxylic Acid Ester

A preferred class of these polymers are methacrylate ester copolymers of the formula

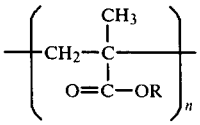

where R is a mixture of alkyl groups containing from 14 to 16 carbon atoms and n is a number providing a molecular weight of the copolymer of about 2000 to 100,000 ($\overline{M}_n$).

A very satisfactory material of this type is a copolymer wherein R of the above formula is predominantly a mixture of tetradecyl, pentadecyl and hexadecyl groups in the proportion of about 5–25% of tetradecyl, 5–20% of pentadecyl and 5–25% of hexadecyl and all three groups comprise at least about 35 wt. % of the alkyl groups. A very satisfactory material of this latter type is a copolymer wherein R of the above formula is predominantly a mixture of tetradecyl and hexadecyl groups in the proportion of about 100–0% of the former to 0–100% of the hexadecyl and of molecular weights ($\overline{M}_n$) within the range of 2,000 to 100,000 and which is readily soluble in a mineral lubricating oil.

A commercial methacrylate ester copolymer of this type which is predominantly a pour depressant for mineral lubricating oils, is sold under the trade name of "Acryloid 152" by Rohm and Haas, wherein about 43 wt. % of R is a mixture of tetradecyl, pentadecyl and hexadecyl alkyl groups and the molecular weight of the polymer is about 10,000–30,000 ($\overline{M}_n$). This commercial methacrylate copolymer is sold in the form of about a 40% concentrate of the active polymer in a light colored mineral lubricating oil base, providing a clear amber-colored viscous liquid. Preparation of such polyester has been generally described in U.S. Pat. Nos. 2,091,627 and 2,100,993.

The distillate hydrocarbon oils which are treated with the co-additives of this invention are wax-containing atmospheric distillate petroleum oils boiling in the range of 120° to 480° C., having a viscosity of 1.6 to 7.5 centistokes at 38° C., having less than 3 wt. % (at about 7° C. below the cloud point of said oil), based on the total weight of said oil, of n-paraffin wax boiling above 350° C. and having less than about 15 wt. % residual component (preferably less than 10 wt. %) whereby said oils have been improved in their low temperature flow properties.

Usually the treated oil, e.g., the fuel, will have less than 1 wt. % of said wax (separable at 7° C. below the cloud point) boiling above about 350° C. The invention is particularly effective for the cold flow treatment of non-responsive high end point fuels, i.e. those fuels wherein at least about 5 wt. % boil at a temperature of greater than about 350° C. (ASTM-1160) and/or have more than about 30 wt. % of said wax having a m.p. of at least about 35° C. and a boiling point greater than about 350° C.

The combinations of the invention may be used alone or in combination with still other oil additives, e.g. corrosion inhibitors, antioxidants, sludge inhibitors, etc.

The invention will be further understood by reference to the following examples which include preferred embodiments of the invention.

EXAMPLES

The following materials were used:

Polymer 1

Polymer 1 is a copolymer of ethylene and vinyl acetate. This copolymer was prepared by the following procedure; A three liter stirred autoclave was charged with 50 ml. of vinyl acetate in 700 ml. of benzene as solvent. The autoclave was then purged with nitrogen and then with ethylene. The autoclave was then heated to 105° C. while ethylene was pressured into the autoclave until the pressure was raised to 1400 psig. Then, while maintaining a temperature of 105° C. and said 1400 psig. pressure, 20 ml/hr. of vinyl acetate and a solution consisting of 5 wt. % di-lauroyl peroxide dissolved in benzene, were continuously pumped into the autoclave at an even rate. A total of 43 ml. of vinyl acetate was injected over 2.1 hours while 13 g. of the peroxide in the form of the solution was injected into the reactor over a period of 2.6 hours from the start of the injection. After the last of said peroxide was injected, the batch was maintained at 105° C. for an additional 10 minutes. Then, the temperature of the reactor contents was lowered to about 60° C., the reactor was depressurized, and the contents were discharged from the autoclave. The empty reactor was rinsed with 1 liter of warm benzene (about 50° C.) which was added to the product. The product was then stripped of the solvent and unreacted monomers on a steam bath overnight by blowing nitrogen through the product. The final stripped product consisted of about 185 grams of copolymer of ethylene and vinyl acetate having a number average molecular weight of 3047 (as measured by VPO) and a ester content of 11.6 weight percent.

Polymer A

Polymer A was a polyalkyl methacrylate, Acryloid 152, purchased from Rohm & Haas of Philadelphia, Penna. The alkyl content of this polyester had a carbon number distribution as follows:

| | | |
|---|---|---|
| $C_{12}$ | — | 6.3 wt. %; |
| $C_{13}$ | — | 8.3 wt. %; |
| $C_{14}$ | — | 10.2 wt. %; |
| $C_{15}$ | — | 9.4 wt. %; |
| $C_{16}$ | — | 12.6 wt. %; |
| $C_{17}$ | — | 6.6 wt. %; |
| $C_{18}$ | — | 11.3 wt. %; |
| $C_{19}$ | — | 4.3 wt. %; and |
| $C_{20}$ | — | 5.4 wt. % |

with a number average molecular weight of 17,100 and a weight average molecular weight of 39,000 (determined by Gel Permeation Chromatography).

Polymer B

Polymer B is a homopolymer of n-tetradecylacrylate. The monomer was prepared as follows:

To a 500 ml. round bottom flask equipped with stirrer, heating mantle, condenser and Dean-Starke receiver was added 107 g. n-tetradecanol, 40 g. acrylic acid, 1 g. hydroquinone, 3 g. p-toluenesulfonic acid, and 150 ml reagent heptane. The solution was refluxed for 3 hours at which point 11 ml. of water was collected in the Dean-Starke receiver. The solution was then washed with 75 ml. water, 75 ml. 2% sodium hydroxide solution and additional water washed till neutral. The solution was dried over magnesium sulfate, filtered and evaporated off leaving 125 g. of tetradecyl acrylate.

Tetradecyl acrylate homopolymer was prepared as follows: To a round bottom microflask equipped with stirrer, condenser, heating mantle, and nitrogen inlet tube, were added 6 g. of the above tetradecyl acrylate, 6 g. of reagent heptane, and 0.06 g. benzoyl peroxide. The solution was sparged with nitrogen then heated with stirring to about 85° C. for a total of 45 minutes. Then 0.1 g. hydroquinone was added and the solvent evaporated leaving 5.8 g. polymer having a $\overline{M}_n$ of 6196.

Polymer C

This was a copolymer of n-hexadecyl acrylate and methyl methacrylate having a $\overline{M}_n$ of 2817. The hexadecyl acrylate was prepared substantially as the tetradecyl acrylate of Polymer B except that 122 g. of n-hexadecyl alcohol was used in the preparation of the acrylate ester. The copolymerization was carried out substantially as in Polymer B above except that a mixture of 7.2 g. hexadecyl acrylate and 1.3 g. methyl methacrylate was used.

Polymer D

This was a copolymer of tetradecylacrylate and acrylonitrile having a $\overline{M}_n$ of less than 10,000. The tetradecylacrylate was prepared by the procedure set forth in Polymer B. The copolymer was prepared substantially as that for the preparation of Polymer B except that the tetradecylacrylate was replaced with a mixture of 6.6 grams of tetradecylacrylate and 1.3 grams of acrylonitrile with a resulting yield of 7.2 grams of Polymer D.

The Fuel

The property of the distillate fuel oil tested is summarized in Table I which follows:

TABLE

| Properties | Atmospheric Distillate Fuel |
|---|---|
| Gravity, 16° C. | 0.8265 |
| Cloud Point, °C | +1 |
| Aniline Point, °C. | 71 |
| Viscosity (centistokes) at 38° C. | 2.46 |
| Wax (wt. %), −6° C. | 1.5 |
| n-paraffin C distribution in wax | $C_{11}$–$C_{34}$ |
| Distillation, ° C. (as measured by ASTM-D-1160) | |
| IBP | 156 |
| 20% | 185 |
| 30% | 200 |
| 40% | 226 |
| 50% | 261 |
| 80% | 328 |
| 90% | 352 |
| FBP | 355 |
| Residual Components | less than 10 wt. % |

Various blends of Polymer I with Polymers A to D in the fuel were made by simply dissolving polymer in the fuel oil. This was done while warming, e.g., heating the oil and polymer to about 90° C. if the polymer per se was added, and stirring. In other cases, the polymer was simply added with stirring to the fuel in the form of an oil concentrate which was usually about 50 wt. % polymer dissolved in a light mineral oil.

The blends were then tested for their cold flow properties in the test described below.

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum", Volume 52, Number 510, June 1966 pp. 173–185. In brief, the Cold Filter Plugging Point Test is carried out with a 45 ml. sample of the oil to be tested which is cooled in a bath maintained at about −34° C. Every one degree drop in temperature, starting from 2° C. above the cloud point, the oil is tested with a test device consisting of a pipette to whose lower end is attached an inverted funnel. Stretched across the mouth of the funnel is a 350 mesh screen having an area of about 0.45 square inch. A vacuum of about 7" of water is applied to the upper end of the pipette by means of a vacuum line while the screen is immersed in the oil sample. Due to the vacuum, oil is drawn across the screen up into the pipette to a mark indicating 20 ml. of oil. The test is repeated with each one degree drop in temperature until the oil fails to fill the pipette to the aforesaid mark due to clogging of the screen with wax crystals. The results of the test are reported as the temperature in ° C. at which the oils fail to fill the pipette in the prescribed time.

The blends prepared and the test results are summarized in Table II which follows:

TABLE II

EFFECTIVENESS OF POLYMERS IN THE FUEL

| Example | Polymer | CFPPT, °C. |
|---|---|---|
| 1 | None | +1 |
| 2 | 0.01% Polymer 1 | 0 |
| 3 | 0.02% Polymer A | +1 |
| 4 | 0.02% Polymer B | 0 |
| 5 | 0.02% Polymer C | 0 |
| 6 | 0.02% Polymer D | −1 |
| 7 | 0.005% Polymer 1<br>0.01% Polymer A | −5 |
| 8 | 0.003% Polymer 1<br>0.014% Polymer B | −4 |
| 9 | 0.005% Polymer 1<br>0.01% Polymer D | −5 |
| 10 | 0.005% Polymer 1<br>0.01% Polymer C | −4 |

The improved synergistic results obtained by the teachings of this invention are apparent from the foregoing Table, e.g. the blend of Example 2 gives a CFPPT of 0° C., the blend of Example 3 gives a CFPPT of +1° C. whereas 50/50 mixtures of the blends of Examples 2 and 3 give a markedly lower CFPPT of −5° C. (similarly synergism is apparent in the results of Examples 2, 5 and 9 whereby the CFPPT is lowered to −5° C.).

The atmospheric distillate hydrocarbon oils which can be treated according to this invention have been earlier characterized as having a broad boiling range of about 120° C. to about 480° C., a viscosity range at 38° C. of from 1.6 to 7.5 centistokes, having a separable wax content of less than 3 wt. % as determined at 7° C. below the cloud point of said oil and a residual component (i.e. the residues of distillation processes including residues obtained from distillation of crude mineral under atmospheric pressure and under subatmospheric pressure and from thermal or catalytic cracking) of less than about 15 wt. %, preferably less than about 10 wt. %. These atmospheric distillate hydrocarbon oils, preferably, have: a substantial relatively low boiling point component of at least 20 wt. %, optimally at least about 30 wt. %, boiling between the range of about 120° C. to about 230° C. as measured by ASTM-D-1160, and a n-paraffin content of at least 25 wt. % (optimally of at least 35 wt. %, e.g. 45 wt. % to 90 wt. %) of said wax having a melting point of at least about 35° C. and a boiling point of at least about 350° C.

The following is an illustration of the latter optimal n-paraffin content of said separated wax. The fuel of Table I as noted had a n-paraffin distribution of carbon number between $C_{11}$ and $C_{34}$ of the wax which was separated from the fuel at −6° C. (7° C. below the cloud point). The separated wax content is determined by measurement of the amount of wax which crystallizes and is filterable (or otherwise mechanically recoverable) from the fuel at the defined temperature. The n-paraffin content of the separated wax amount to about 62 wt. % of the total separated wax and had the following carbon number distribution in wt. % of the total n-paraffins: $C_{11}$—0.4 wt. %; $C_{12}$—0.4 wt. %; $C_{13}$—0.1 wt. %; $C_{14}$—0.2 wt. %; $C_{15}$—0.5 wt. %; $C_{16}$—0.80 wt. %; $C_{17}$—1.8 wt. %; $C_{18}$—1.5 wt. %; $C_{19}$—1.4 wt. %; $C_{20}$—1.6 wt. %; $C_{21}$—2.6 wt. %; $C_{22}$—4.3 wt. %; $C_{23}$—6.3 wt. %; $C_{24}$—7.9 wt. %; $C_{25}$—9.3 wt. %; $C_{26}$—8.9 wt. %; $C_{27}$—6.7 wt. %; $C_{28}$—4.1 wt. %; $C_{29}$—2.4 wt. %; $C_{30}$—1.2 wt. %; $C_{31}$—0.5 wt. %; $C_{32}$—0.5 wt. %; $C_{33}$—0.9 wt. %; and, $C_{34}$—0.4 wt. % (carbon number distribution measured by gas chromatography.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. A fuel oil consisting of a wax containing atmospheric middle distillate petroleum fuel oil boiling in the range of 120° to 480° C., having at least 30 wt. % boiling between about 120° to about 230° C. and at least 5 wt. % boiling above 350° C., said oil having a viscosity of 1.6 to 7.5 centistokes at 38° C. and leaving less than 3 wt. %, based on the total weight of the fuel, of n-paraffin wax boiling above 350° C. and separable from said oil at a temperature of about 7° C. below the cloud point of said oil, said oil containing in the range of about 0.005 to 0.1 wt. %, based on the weight of the total composition, of a synergistic flow improving combination of (a) one part by weight of an oil soluble ethylene-ester copolymer having a number average molecular weight less than about 4000 per (b) 0.2 to 4 parts by weight of an oil-soluble polyester having a number average molecular weight in the range of about 2000 to 100,000;

wherein said ethylene-ester copolymer consists essentially of 4 to 20 molar proportions of ethylene with a molar proportion of vinyl acetate; and wherein said polyester consists of alkyl acrylate or alkyl methacrylate moieties, and said moieties consist essentially of $C_{14}$ to $C_{16}$ straight chain alkyl ester of acrylic or methacrylic acid.

2. A fuel oil according to claim 1 wherein said polyester is a homopolymer consisting of tetradecylacrylate moieties.

3. A fuel oil according to claim 1 wherein said polyester is a copolymer consisting of hexadecyl acrylate and methyl methacrylate moieties.

* * * * *